US005376316A

United States Patent [19]

Weekers

[11] Patent Number: 5,376,316

[45] Date of Patent: Dec. 27, 1994

[54] METHOD OF MAKING A CONCRETE COLUMN WITH A CONCRETE COLUMN FORMING TUBE

[75] Inventor: Emile E. A. J. Weekers, Bunde, Netherlands

[73] Assignee: Sonoco Products Company, Hartsville, S.C.

[21] Appl. No.: 203,799

[22] Filed: Mar. 1, 1994

Related U.S. Application Data

[62] Division of Ser. No. 916,207, Jul. 17, 1992, Pat. No. 5,328,142.

[51] Int. Cl.[5] ..... B28B 7/00; E04B 1/16

[52] U.S. Cl. ..... 264/32; 264/35; 264/219; 264/313

[58] Field of Search ..... 264/32, 35, 313, 333, 264/219, 39

[56] References Cited

U.S. PATENT DOCUMENTS

| | | | |
|---|---|---|---|
| 1,163,375 | 12/1915 | Selfridge . | |
| 2,677,165 | 5/1954 | Copenhaver et al. . | |
| 2,836,874 | 6/1958 | Clarkson . | |
| 2,914,833 | 12/1959 | Hart, Jr. et al. . | |
| 3,020,615 | 2/1962 | Peters . | |
| 3,350,049 | 10/1967 | Reiland . | |
| 3,599,928 | 11/1968 | Strong . | |
| 3,644,611 | 7/1970 | Wiles . | |
| 3,888,959 | 6/1975 | Phillips . | |
| 3,956,437 | 5/1976 | Ellis . | |
| 3,979,100 | 9/1976 | Phillips . | |
| 3,980,268 | 9/1976 | Ellis . | |
| 4,083,526 | 4/1978 | Hatfield . | |
| 4,595,168 | 6/1986 | Goodwin . | |
| 4,767,095 | 8/1988 | Fitzgerald et al. . | |
| 4,790,509 | 12/1988 | Cardwell et al. . | |
| 4,876,054 | 10/1989 | Goodwin | 264/333 |
| 4,957,270 | 9/1990 | Rummage et al. . | |
| 5,043,033 | 8/1991 | Fyfe . | |
| 5,169,585 | 12/1992 | LeGourrierec | 264/333 X |
| 5,229,051 | 7/1993 | Martin | 264/DIG. 69 X |

*Primary Examiner*—Karen Aftergut

*Attorney, Agent, or Firm*—Bell Seltzer Park & Gibson

[57] ABSTRACT

A lightweight concrete forming tube is disclosed, and wherein the tube has a very thin wall of wound paper layers which permit the tube to be collapsed and wound into a reel to facilitate shipment and storage. In use, the desired length is severed from the reel, and the severed length is opened and positioned about a vertically disposed steel reinforcing structure. Concrete is then poured into the opened tube, and the hydrostatic pressure of the liquid concrete causes the tube to assume a circular cross-section and straight vertical configuration. Upon hardening of the concrete, the tube is severed with a knife and removed, leaving a formed concrete column of circular and straight configuration.

5 Claims, 2 Drawing Sheets

Fig. 1.
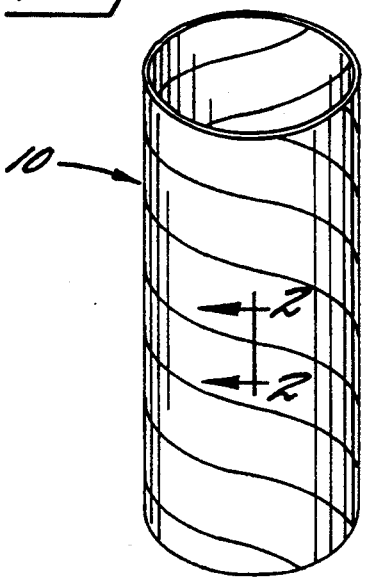
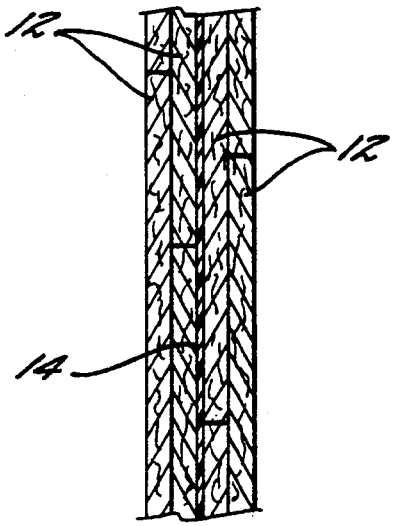
Fig. 2.
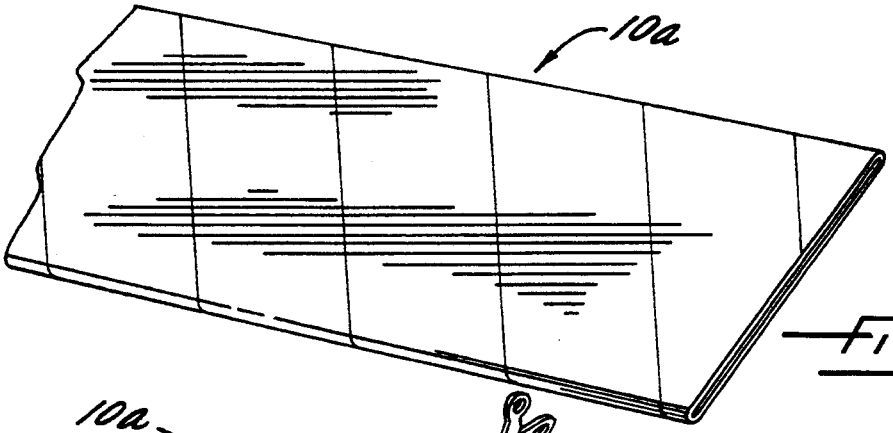
Fig. 3.
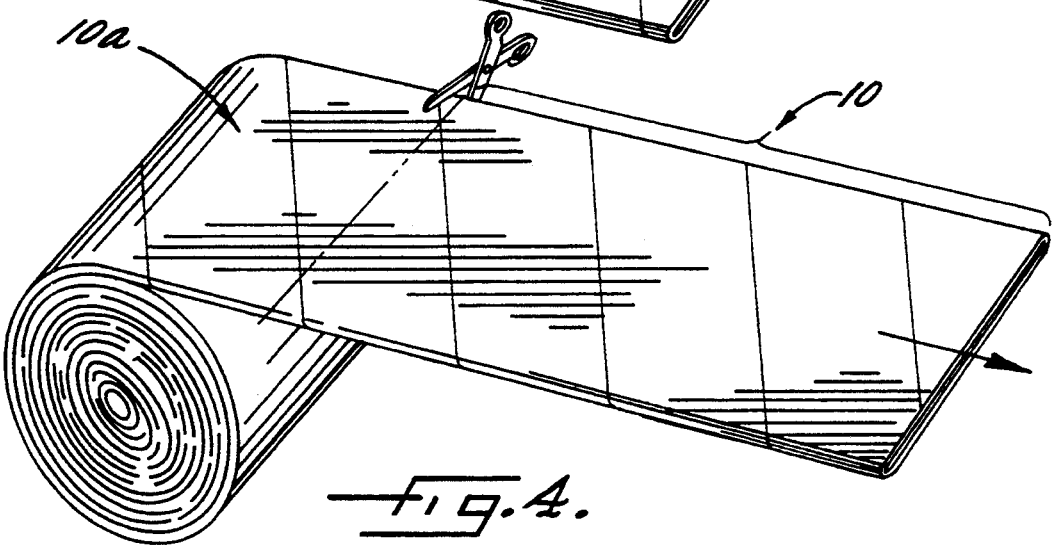
Fig. 4.

METHOD OF MAKING A CONCRETE COLUMN WITH A CONCRETE COLUMN FORMING TUBE

This application is a divisional of application Ser. No. 07/916,207, filed Jul. 17, 1992, now U.S. Pat. No. 5,328,142.

BACKGROUND OF THE INVENTION

The present invention relates to a concrete column forming tube that is adapted to have liquid concrete poured into the interior of the tube and so as to form a round concrete column upon hardening of the concrete.

Concrete column forming tubes are conventionally formed of multiple layers of paper which are spirally or convolutely wound, and with the walls of the tube having a thickness of at least about 6 mm so that the tube is rigid and maintains its circular cross-sectional configuration. By reason of the large diameter and length of such tubes, the transport, handling and storage of the tubes involve significant costs and inconvenience.

It is an object of the present invention to provide a concrete column forming tube, and the method of utilizing such tube, wherein the transport, handling and storage of the tube is greatly facilitated, with the attendant reduction in cost.

SUMMARY OF THE INVENTION

The above and other objects and advantages of the present invention are achieved by the discovery that such forming tubes may be fabricated so as to have extremely thin and flexible paper walls, which render the tubes collapsible into a flat or kidney shaped form. The flexible nature of the walls does not result in a non-circular or non-uniform formed concrete column as one would expect, and it has been discovered that the hydrostatic pressure of the liquid concrete which is poured into the tube serves to reestablish a perfectly round and straight configuration until the concrete has hardened.

In accordance with the specific features of the present invention, the concrete column forming tube comprises a plurality of wound layers of flexible sheet material, such as high quality kraft paper, which are bonded together to form a cylindrical tube, with at least one of the layers being substantially impervious to the passage of water, and with the tube having a diameter of at least about 150 mm. The total thickness of the wound layers is sufficiently thin to permit the tube to be readily collapsed into a generally flat condition, which may be somewhat kidney shaped.

In a preferred embodiment, the concrete column forming tube is longitudinally collapsed and wound into a reel to facilitate transport, handling and storage. At the job site, a desired length of the tube is withdrawn from the reel, and the desired length is severed from the remainder of the tube. The severed tube length is then opened and positioned in a generally vertical orientation, and, typically, the tube is positioned so as to coaxially surround a steel reinforcing grid. Concrete is then poured into the opened and vertically disposed tube so as to cause the tube to assume a round and straight configuration. The concrete then hardens, and the tube may then be removed from the formed concrete column. As an alternative to forming the collapsed tube into a reel, it can be initially cut into fixed lengths which are then stacked on pallets for storage and shipment.

BRIEF DESCRIPTION OF THE DRAWINGS

Some of the objects and advantages of the present invention having been stated, others will appear as the description proceeds, when taken in conjunction with the accompanying drawings, in which:

FIG. 1 is a perspective view of a concrete column forming tube which embodies the features of the present invention;

FIG. 2 is a fragmentary sectional and enlarged view of the wall of the tube which is taken substantially along the line 2—2 of FIG. 1;

FIG. 3 is a perspective view of a portion of the tube in the collapsed configuration;

FIG. 4 is a view similar to FIG. 3 but further illustrating the collapsed tube rolled into a reel;

DETAILED DESCRIPTION OF THE PREFERRED EMBODIMENT

Figure 5:
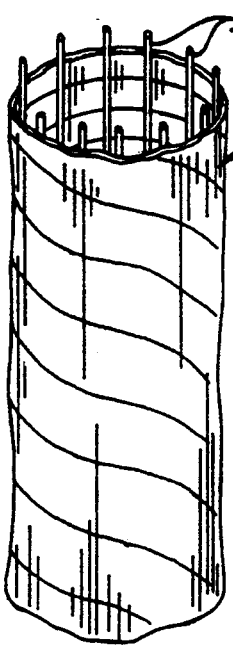
FIGS. 5–7 illustrate the sequential steps involved in forming a concrete column with the tube of the present invention.

FIGS. 1 and 2 illustrate a preferred embodiment of a concrete column forming tube in accordance with the present invention and which is indicated generally at 10. The tube 10 typically comprises four or five wound layers of paper, and one wound layer of water impermeable plastic film intermediate the paper layers. The position of the plastic film layer can be anywhere between the inside and outside of the tube wall. Instead of a separate layer of plastic film, special sandwich paper which includes a plastic layer embedded in the paper can be used. In the illustrated embodiment, the tube 10 comprises four wound layers of paper 12, and one wound layer of plastic film 14 positioned intermediate the four layers of paper. The several layers are preferably spirally wound with butt joints and adhesively joined in the conventional manner, although other wound constructions would be suitable. For example, the tube could include skived and overlapped joints in order to provide a more smooth interior surface for contacting the concrete. Also, the tube could be convolutely wound in the conventional manner.

The tube 10 has a diameter of at least about 150 mm, and typically such tubes range in diameter from about 150 mm to about 1 meter, depending upon the desired diameter of the round concrete column being formed. The length of such tubes typically ranges up to about 10 meters.

The paper layers 12 of the tube are preferably composed of high quality paper, and of the type conventionally designated as kraft paper in the paper industry. Each paper layer 12 has a thickness which is preferably not greater than about 0.5 mm. The plastic layer 14 may be composed of polyethylene film or other suitable plastic material and has a thickness which preferably is not greater than about 0.3 mm. The overall thickness of the wall of the tube is sufficiently thin to permit the tube to be readily collapsed into a generally flat condition. In order to achieve this functional result in tubes having a diameter of 150 mm and greater, the wall thickness should not be greater than about 3 mm, and preferably between about 0.5 and 3 mm.

The presence of the plastic layer 14 renders the wall of the tube substantially impervious to the passage of water, which is desirable in order to protect the tube from the weather prior to use and to retain the liquid concrete during use. As an alternative, or in addition to the use of the plastic layer 14, the paper layers 12 may be impregnated or coated with wax, bitumen, or silicon to render them water repellant and substantially impervious to the passage of water. Preferably, at least the inside layer is so impregnated. The adhesive used to join the several layers should also be of the water resistant type.

In the manufacturing process, a continuous tube is continuously formed, and the continuous tube may be cut into desired lengths, which can be stored and packaged in their original round configuration, or flattened and then packaged in their flattened condition. However, it is preferred to run the continuous tube through a folding press to collapse the tube into a generally flattened condition, as seen at 10*a* in FIG. 3. Further, the collapsed continuous tube 10*a* is preferably then wound into a roll, as seen in FIG. 4, to further facilitate handling, storage and shipment to the job site. The flattened tube will typically assume a kidney shaped form, wherein the edges are somewhat rounded rather than totally flattened. The phrase "generally flattened" as used herein is intended to encompass this kidney shaped form.

At the job site, a desired length of the tube 10*a* is withdrawn from the roll and severed by a knife or scissors from the remainder of the tube as schematically illustrated in FIG. 4. The resulting cut tube 10 is then opened and positioned in a generally vertical orientation, as seen in FIG. 5. As there illustrated, the thin, flexible, and somewhat flimsy nature of the wall of the tube 10 usually results in the tube assuming a somewhat non uniform and irregular outline when it is disposed in a vertical, opened orientation. In many applications, the concrete column to be formed will have an internal steel reinforcing grid 16, and thus the opened tube is positioned so as to coaxially surround the grid, and the grid 16 serves to help support the tube 10.

Figure 6:
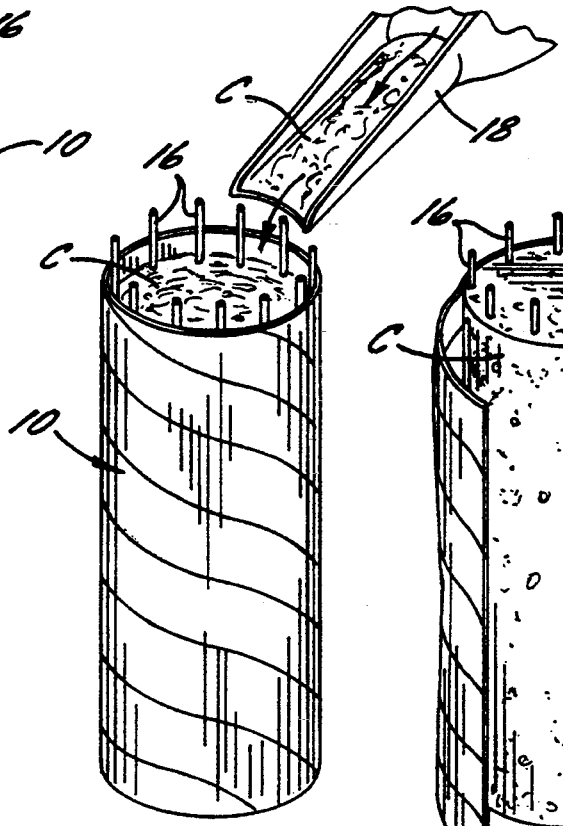
Figure 7:
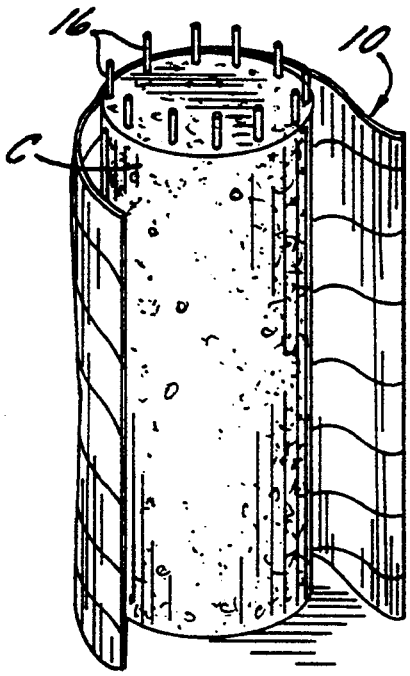

Next, liquid concrete C is poured into the vertically positioned tube 10 via a chute 18 or other conveyor system, as illustrated in FIG. 6, and in this regard, it has been found that the hydrostatic pressure of the liquid concrete causes the tube 10 to assume a round and straight configuration. The concrete C is then allowed to cure, and the tube 10 is then removed from the formed concrete column. Such removal may be effected by simply cutting the tube with a knife, as illustrated in FIG. 7. Alternatively, a seam gap may be formed in the tube 10 which permits it to be unspiraled from the concrete.

As an alternative procedure for vertically supporting the opened tube, a series of notches may be cut in the upper end of the tube so as to form a plurality of flaps about the upper end. These flaps may then be folded outwardly and secured to a supporting frame by nails or the like, and so that the tube hangs vertically downwardly from the supporting frame and in a position ready to receive the concrete.

Figure 8:
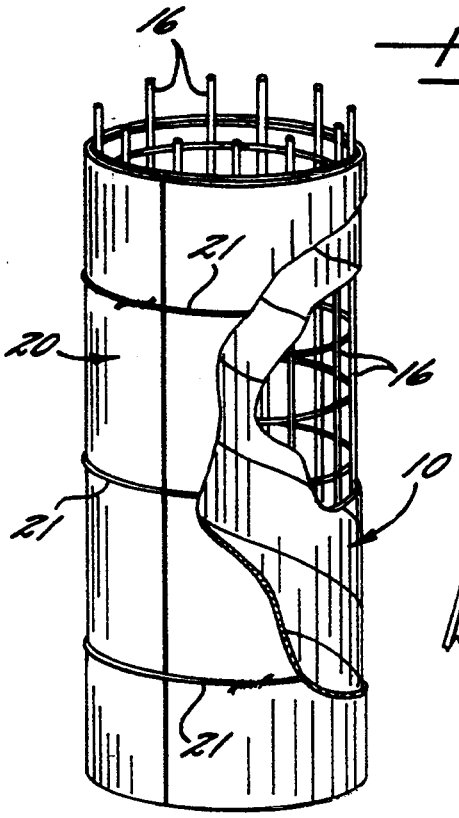
FIG. 8 is a view similar to FIG. 5 but further illustrating a support tube which is adapted to enclose the exterior surface of the forming tube during erection of the forming tube and pouring of the concrete.
Figure 9:
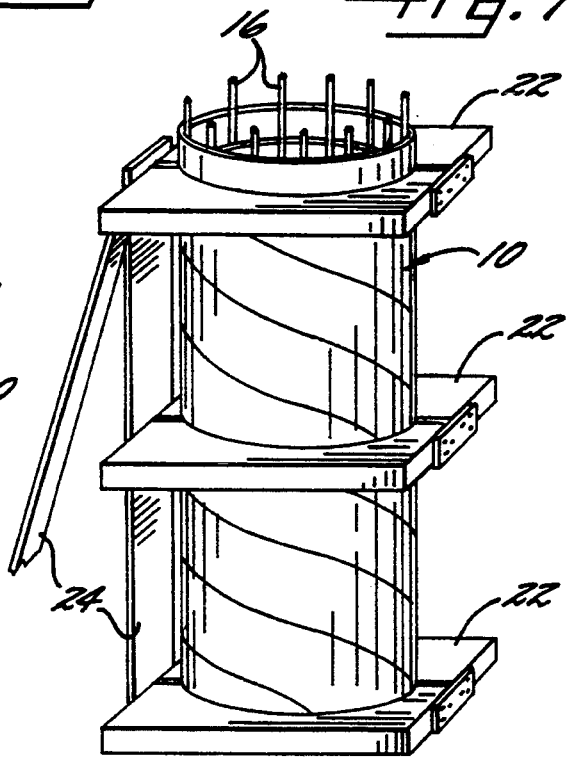
FIG. 9 is a view similar to FIG. 8 but illustrating a further embodiment of a structure for supporting the exterior surface of the forming tube.

In view of the thin, flexible nature of the walls of the tube, it might not have sufficient integrity to be self-supporting in the case of relatively long tubes. Specifically, long tubes may tend to bulge, particularly at the bottom of the tube, from the weight of the concrete. In such cases, FIGS. 8 and 9 illustrate two embodiments for supporting the exterior surface of the opened tube so as to maintain its generally vertical orientation and to prevent bulging. As seen in FIG. 8, a vertically split exterior support tube 20 having relatively thick rigid walls is disposed coaxially about the forming tube 10. The split support tube 20 is held together with wires or bands 21 so as to form a tubular cylinder which closely surrounds and supports the forming tube 10. After the concrete C has been poured into the forming tube and cures, the support tube 20 may be removed by releasing the circumferential wires or bands 21.

In the embodiment of FIG. 9, a number of wooden support frames 22 are disposed about the forming tube 10 at spaced locations along its length, with the support frames being, in turn, supported by a temporary wooden framework 24. Here, again, once the concrete C has been poured in the forming tube 10 and cures, the support frames 22 may be removed. In further embodiments, a plurality of axially spaced apart bands (not shown) can be positioned circumferentially about the forming tube, preferably adjacent its lower end, so as to prevent bulging of the tube from the weight of the concrete. Also, one or more reinforcing wraps of paperboard (not shown) can be placed around the base of the forming tube and held in position with tape.

In the drawings and specification, there has been set forth a preferred embodiment of the invention, and although specific terms are employed, they are used in a generic and descriptive sense only and not for purposes of limitation.

What is claimed is:

1. A method of forming a concrete column comprising the steps of providing a lightweight and readily collapsible column forming member comprising at least one layer of flexible sheet material which is wound to form a flexible multi-layer wall of a cylindrical tube, with the wall being substantially impervious to passage of water, with a total thickness of the multi-layer wall being between about 0.5 and 3 mm and thus sufficiently thin to impart flexibility to the tube and to permit the tube to be readily collapsed into a generally flattened condition, and with the tube having a diameter of at least about 150 mm and having sufficient strength to support a column of concrete poured therein, collapsing the tube into a longitudinally folded and generally flattened condition to facilitate storage and shipment of the tube to a job site, opening the folded tube at the job site and positioning the opened tube in a generally vertical orientation to support a column of concrete poured therein, pouring concrete into the opened and vertically positioned tube so as to cause the tube to assume a round and straight configuration due to hydrostatic pressure of the concrete poured therein, and allowing the concrete to harden into the concrete column and then removing the tube from the hardened concrete column.

2. The method as defined in claim 1 wherein the step of collapsing the tube includes winding the collapsed tube into a reel, and withdrawing a desired length of the tube from the reel and severing the desired length from a remainder of the tube.

3. The method as defined in claim 1 wherein the step of positioning the opened tube in a generally vertical orientation includes positioning the opened tube over a vertically disposed steel reinforcing structure.

4. The method as defined in claim 3 wherein the step of positioning the opened tube in a generally vertical orientation includes supporting an exterior surface of the opened tube so as to maintain its open and generally vertical orientation.

5. The method as defined in claim 1 wherein the collapsible column forming member comprises a plurality of wound layers of paper, with the wound layers having a total thickness of between about 0.5 to 3 mm.

* * * * *